United States Patent [19]

Krogsrud

[11] 4,375,960

[45] Mar. 8, 1983

[54] MEANS FOR TRANSPORTING/ROTATING THE POT OF A SMELTING FURNACE

[75] Inventor: Harald Krogsrud, Gjettum, Norway

[73] Assignee: Elkem A/S, Oslo, Norway

[21] Appl. No.: 232,723

[22] Filed: Feb. 9, 1981

[30] Foreign Application Priority Data

Feb. 27, 1980 [NO] Norway ..... 800545

[51] Int. Cl.[3] ..... F27D 3/00

[52] U.S. Cl. ..... 432/239; 432/138

[58] Field of Search ..... 432/62, 138, 157, 158, 432/239; 266/142, 143; 280/DIG. 7

[56] References Cited

U.S. PATENT DOCUMENTS

| | | | |
|---|---|---|---|
| Re. 24,272 | 2/1957 | Albee | 280/DIG. 7 |
| 398,973 | 3/1889 | Pietzka | 432/138 |
| 3,434,606 | 3/1969 | Asamura | 266/142 |
| 3,622,073 | 11/1971 | Cayre | 280/DIG. 7 |
| 3,791,535 | 2/1974 | Baker et al. | 266/142 |
| 3,975,575 | 8/1976 | Krogsrud | 65/337 |
| 3,985,496 | 10/1976 | Eickelberg | 432/122 |

FOREIGN PATENT DOCUMENTS 339735 10/1971 Sweden .

*Primary Examiner*—John J. Camby

*Attorney, Agent, or Firm*—Eyre, Mann, Lucas & Just

[57] ABSTRACT

The present invention relates to means for transporting-/rotating the pot of a smelting furnace. The invention is particularly adapted to furnaces having rotating furnace pots and in particular to furnaces with a split furnace body. The pot is locked from rotation simply by letting the furnace pot rest on its foundation during intervals in which the pot is supposed to be at rest. The pot is rotatably arranged with respect to the furnace foundation and the rotation is produced by means of a plurality of transport means. The transport means are preferably evenly arranged around the circumference of the pot. The transport means comprises lifting means which periodically lift the pot partly or completely off its foundation. The lifting means are preferably of a type which provide a lifting force in vertical direction, either by means of a hydraulic medium or compressed air. The lifting means may for example be formed by one or more flexible hoses which communicates with a pressure producing source. According to the present invention the resistance of rotation imposed by the charge material may provide rotation of the pot, said resistance being exploited to transfer rotation from the upper section to the lower section of the pot.

6 Claims, 4 Drawing Figures

MEANS FOR TRANSPORTING/ROTATING THE POT OF A SMELTING FURNACE

Figure 1:
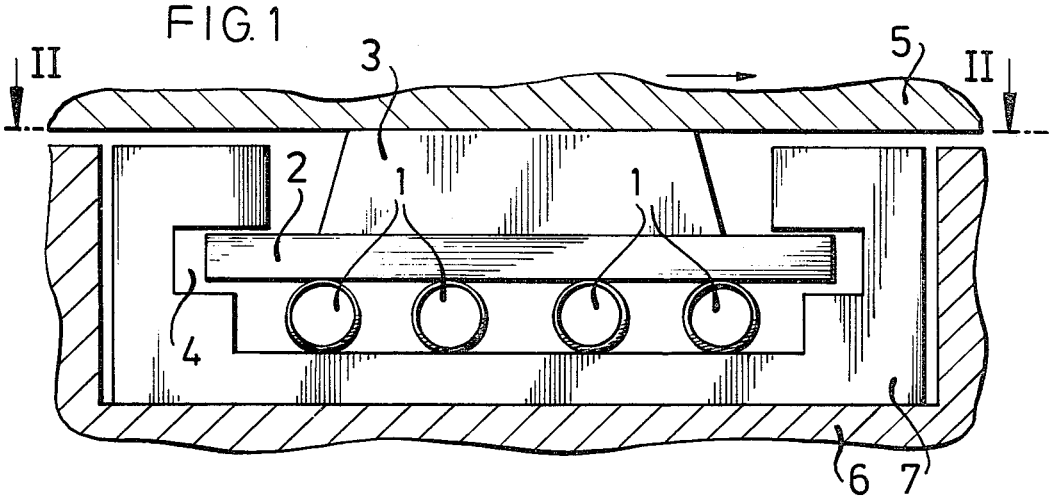

The present invention relates to means for providing an intermittent motion of a very heavy body. More particularly, but not exclusively, the present invention relates to means for providing rotation of a furnace pot used in electrometallurgical smelting.

In the following the present invention will be described in conjunction with smelting furnaces for instance used for the production of ferro alloys.

For such type of smelting processes a rotation of the furnace pot with respect to the electrodes and the furnace accessories provides interent advantages. Further, it is advantageous to use a split furnace body comprising an upper and a lower pot section where the two pot sections are designed to rotate independent of each other. From a metallurgical point of view it is convenient to rotate the upper and the lower pot section in the same direction. However, in order to achieve a relative motion between the two sections, the lower section is rotated with a substantial lower angular velocity than the upper section.

In order to provide rotation of a furnace pot it has previously been proposed to provide the lower end of the pot with wheels, rotating on rails. The axis of rotation of the wheels are radially arranged. The wheels are driven by one or more motors which by means of transmission means rotates the furnace pot in required direction. The time required for one complete revolution may vary, depending on the type of process. It should be appreciated, however, that the system is based on low angular velocity. Usually the period of one revolution is in the order of 50 hours to 250 hours.

According to the conventional furnace pot types the two separate furnace pot sections are equipped with separate propulsion machinery. Due to increasing sizes of the furnace and due to the unexpectedly large physical resistance to rotation of the pot imposed by the charge material on the pot wall(s) the size and required power of the propulsion machinery have become prohibitively large. The purchasing cost of said propulsion machinery has increased correspondingly.

It has previously been proposed to omit the propulsion machinery for rotating the lower section of the furnace pot. Instead of a separate propulsion machinery the propulsion machinery applied for rotating the upper pot section is also used for intermittent movement of the lower section, the lower section being locked to the upper section during certain intervals. According to such a solution the previously described resistance to rotation of the charge is exploited, intermittently forcing the lower section to rotate together with the upper section. During the intervals where the lower section is to be at rest, the lower section is prevented from rotating by means of mechanical brakes or locking means. For furnace pots of this type the lower pot section may either rotate in the same direction as the upper pot sections, or it may rotate in opposite direction. In the latter case, the direction of rotation of the upper pot section is reversed during the intervals where also the lower pot section is to rotate in order to provide the required motion of the lower section. When the lower pot section has rotated the required length, the direction of rotation of the upper pot section is once more reversed to its original direction.

The object of the present invention is to provide a pot arrangement which may be rotated around a vertical axis without being dependent upon wheels or separate locking means. Such items represent prohibited purchasing- and working costs.

The present invention is especially adapted to furnaces having rotating furnace pot and in particular to furnaces with a split furnace body. In the latter case, the present invention may be used whether the two sections rotate in the same direction or in opposite direction.

According to the present invention the furnace pot is locked from rotation simply by letting the furnace pot rest on its foundation during the intervals where the pot is supposed to be at rest. For this purpose the pot foundation and/or the external bottom surface are equipped with a slipping resistant surface, such as a frictional layer of any conventional type.

According to the present invention the furnace pot is rotatably supported by the furnace foundation by means of one or more transport means, arranged along the line of rotation of the furnace. The transport means comprises means for partly or completely lifting the pot periodically up from its foundation so as to enable relative motion of the pot with respect to the furnace foundation. The transport means are preferably of a type which produces the lifting effect either by means of a hydraulic medium or by means of compressed air. The lifting means may for instance comprise one or more flexible hoses or the like, the interior of which communicates with a pressure producing source.

The present invention is particularly suitable for use in conjunction with a split furnace where the upper and lower pot section are arranged relatively movable with respect to each other. For such type of furnaces the resistance against rotation imposed by the charge material is exploited to transfer the rotation of the upper section to the lower section of the pot. The length and frequency of the various movements are governed in a conventional manner for example by means of a switch system and a clock.

The method of operation of the transport means incorporates introduction of compressed fluid in the hose, the pressure being produced by a pressure producing source. When exposed to an internal pressure the hoses expand and thereby lift the transport elements up from a non-active position, lifting the furnace pot partly or completely up from its position. The friction between the furnace foundation and the lower end of the furnace pot is thereby reduced or completely neutralized.

When the furnace pot is lifted from its foundation to a required height, the driving means rotating the upper section will move the lower section due to the described resistance of rotation imposed by the charge. The furnace pot is further preferably provided with any conventional locking means for preventing the lower section from rotating beyond the required range. By governing the length and frequency of the operating intervals of the transport means, the velocity of rotation of the furnace pot/the lower section of the furnace pot may be regulated.

When the furnace pot/the lower section of the pot has rotated through the required angle, the pressure inside the hoses is released whereby the pot will settle and again come to rest on the furnace foundation due to its own weight. Subsequent to the removal of the internal pressure in the hoses the transport means are withdrawn to its original position, for example by means of spring devices. The transport means are now set for a new successive movement of the pot.

According to the present invention expensive equipment such as wheels, brakes, transmission means, etc. are substituted by more simple and less costly equipment.

Figure 2:
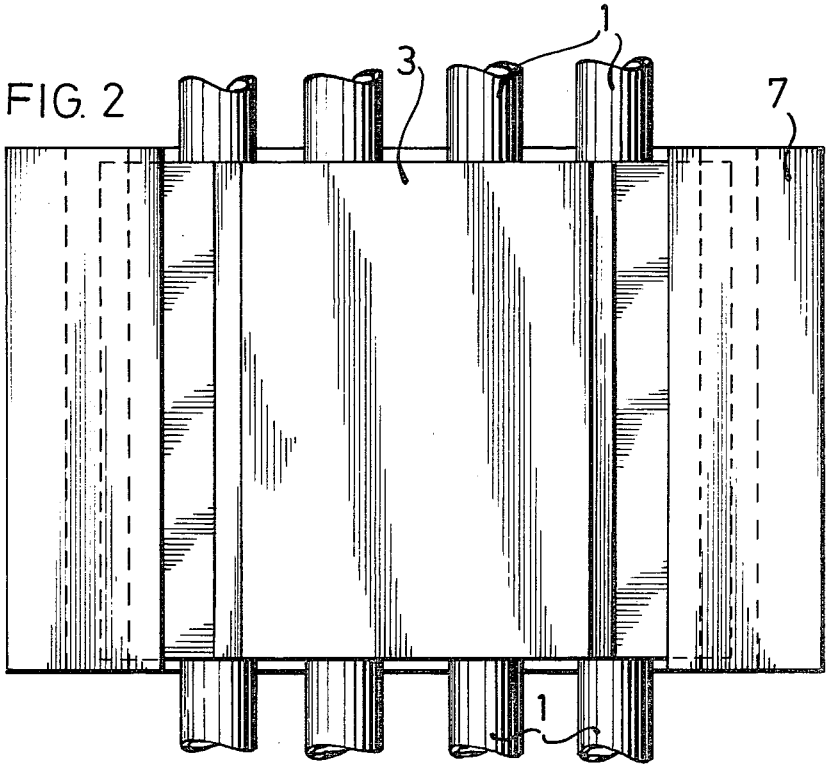
Figure 3:
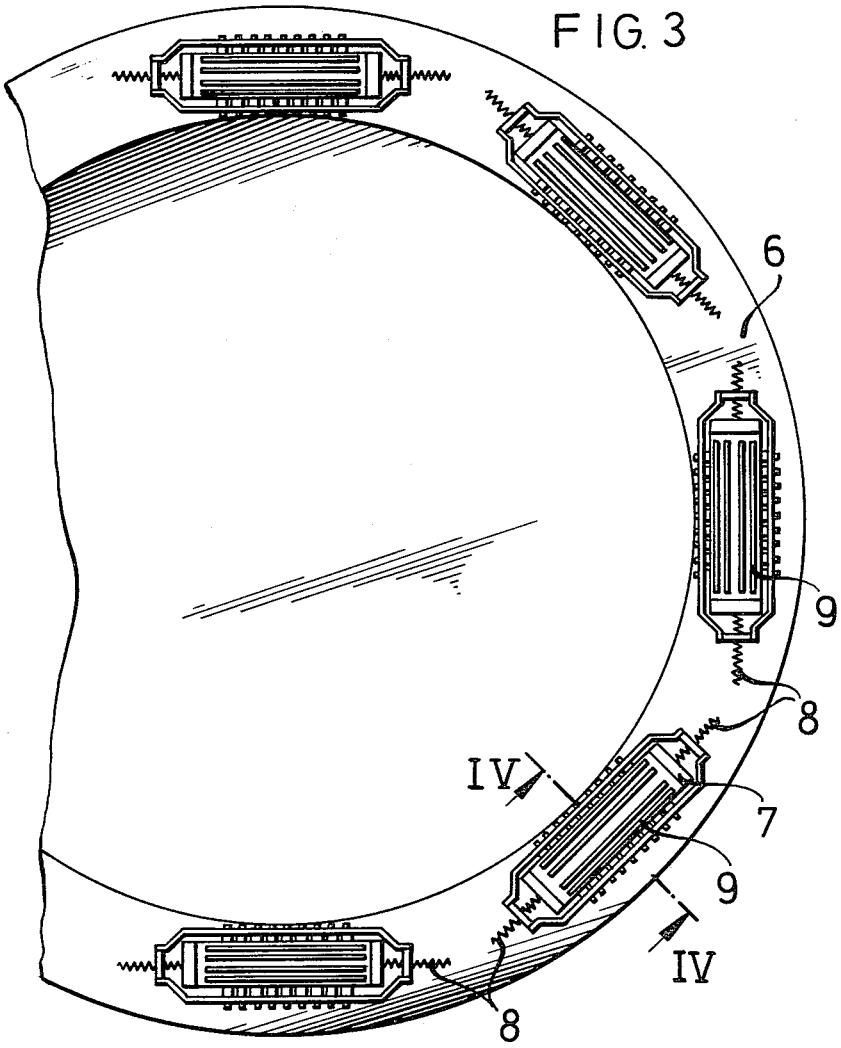
Figure 4:
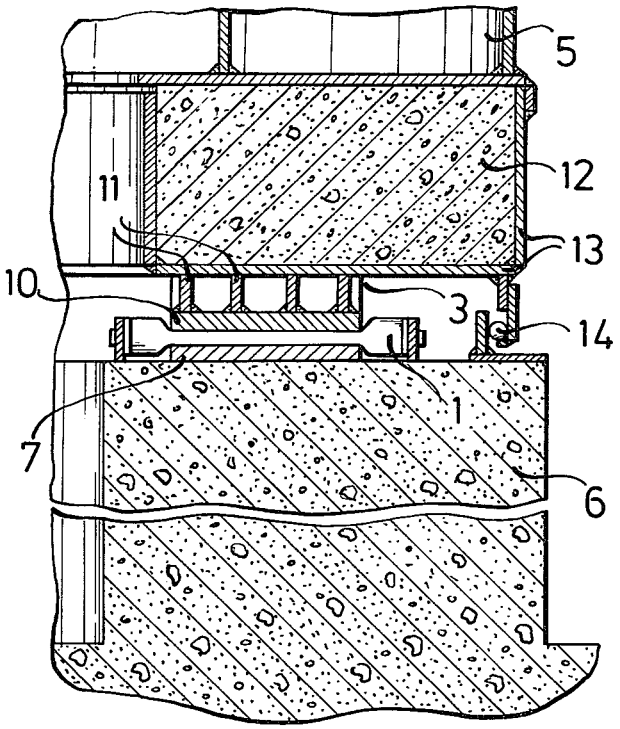

One embodiment of the present invention is illustrated by way of example in the accompanying diagrammatic drawings in which FIG. 1 shows schematically and in principle a vertical view of a transport means according to the present invention, where the transport means is in an active position where the furnace pot is lifted completely off the furnace foundation;

FIG. 2 shows a horizontal view of the transport means shown on FIG. I, seen along the line A—A on FIG. I;

FIG. 3 shows a horizontal view of sections of a furnace foundation, excluding the furnace pot, the foundation being provided with transport means according to the present invention; and FIG. 4 shows a vertical section through the foundation and parts of the lower end of a furnace pot, seen along line B—B on FIG. III.

FIG. 1 shows rather schematically a vertical view of a transport means according to one preferred embodiment of the present invention. The transport means is shown in an elevated, active position, where the furnace pot/the lower section of the furnace pot 5 is shown in a position lifted off the furnace foundation 6. The Figure disclose only a single transport means. It should be appreciated, however, that several transport means are used, evenly distributed around the plane of rotation of the furnace pot 5.

Principally, the transport means comprises a base section 7 which is rigidly secured to the furnace foundation 6. On the upper, free surface of the base section 7 a plurality of flexible hoses 1, preferably of rubber, are arranged. The hoses 1 are supported or suspended in a frame work (not shown) and communicates with a pressure-supply source (not shown). The hoses 1 have such form and dimensions that they when subjected to an internal pressure, expand and may roll on the upper surface of the section 7. A lifting member 3, for example in the form of a plate or a bar, is arranged on top of the hoses 1. The lifting member 3 is equipped with guiding means 2 which project horizontally outwardly from the lifting member 3 at least in the front and rear end when seen in direction of motion. The horizontally extending guide means cooperate with corresponding guides 4 on the base section 7 of the transport means.

The guides 4 are given a lateral extension which permits the lifting member 3 with guiding means 2 to move a certain distance in the rotational direction, corresponding to the maximum distance which the transport elements are designed to move in one interval. Further, the guides 4 are given a height which permits the lifting member 3 with guiding means 2 to elevate to a certain vertical level which is sufficient to lift the pot 5 sufficiently off the foundation means to allow the pot/the lower section of the pot to rotate relative to the furnace foundation. The guides 4 function further as a stop against undesirable motion of the lifting means 3.

The lifting means 3 are further provided with retraction means such as spring devices (not shown) to return the lifting means 3 to its original position subsequent to accomplished movement in an interval. The retraction means are fixed both to the lifting means 3 and the base section 7.

FIG. 1 shows a horizontal view of a section of the furnace foundation 6, excluding the furnace pot 5. The foundation 6 is provided with transport means (shown schematically) according to the present invention. Principally, these elements function as described above in conjunction with FIGS. 1 and 2.

As shown on FIG. 3 the transport means are evenly distributed along a circle of rotation, substantially along the circumference of the furnace foundation 6. According to the embodiment shown on FIG. III eight transport elements are used. The transport elements are at each end provided with a retraction device 8, such as springs, which enable withdrawal of the transport elements to its original position upon terminated, intermittent movement of the furnace pot 5. As described in connection with the FIGS. 1 and 2 each transport element comprises a plurality of flexible hoses (not shown on FIG. 3) which are suspended in a frame 9 and which communicates with a pressure source (not shown) through a conventional pipe net. The hoses 1 are intended to roll on the base section 7 which according to the embodiment shown on FIGS. 3 and 4 consists of a steel plate or the like. When a pressurized medium is introduced into the hoses 1, these will expand and lift the lifting elements 3 arranged on top of the hoses 1, lifting the furnace pot 5 partly or completely off its foundation 6.

FIG. 4 shows a vertical section through the furnace foundation 6 and parts of the lower part of the furnace pot, seen along the line B—B on FIG. 3. As shown on the Figure transporting means are arranged between the furnace foundation 6 and the lower section of the furnace pot. Each transporting means comprises a base section 7 rigidly fixed to the furnace foundation 6 and lifting means 3. The lifting means 3 comprises a plane horizontal plate 10 and ribs 11, fixed on the upper surface of the plate and extending upwards therefrom. Between the base section 7 and the lifting means 3 a plurality of flexible hoses or tubes 1 are arranged, the tubes 3 preferably being arranged radially with respect to the furnace pot 5. The flexible hoses 1 are rollably suspended in a frame 9 and communicated with a pressure supply source (not shown) producing compressed air or hydraulic pressure. The hoses 1 are dimensioned to allow the furnace pot to be partly or completely lifted off its foundation 6 when pressure is introduced into the hoses. In such a position the furnace pot 5 is allowed to rotate relative to its foundation, the movement being provided for example by means of the resistance to rotate imposed by the charge, or by means of a separate motor (not shown).

According to the shown embodiment the furnace pot 5 is provided with a peripherically orientated ring element 12 at its lower end, the ring element 12 being formed by a frame 13 for example of steel plates. The ring element 12 forms a part of the support system of the furnace pot 5. The furnace foundation 6 comprises several supporting sections (not shown) for supporting the pot 6. Along the periphery of the pot and/or the furnace foundation 6 a sealing member 14 may be arranged in order to prevent dust, dirt, slag etc. to penetrate into the transporting means. The method of operation of the transporting means will now be described.

When the pot/the lower section of the pot 5 is in a stationary state the pot 5 rests on the furnace foundation 6. At such a stage the transporting means are in an in-active, lower position where the guide means 2 rest on the lower edge of the guide 4. In such position the pot 5 rests with all its weight on the foundation thereby preventing any movement of the pot 5. In this position the distance between the upper surface of the base section 7 on which the hoses 1 are supposed to roll and the lower surface of the lifting means 3 is less than the outer diameter of the hose 1.

When the pot/the lower section of the 5 are to be rotated relative to the furnace foundation 6, pressure is introduced from a pressure source (not shown). The hoses 1 will expand and thereby lift the lifting means 3 up from its lower position to an upper position where the pot/the lower section of the pot more or less is completely lifted off the foundation 6 as shown on FIG. 1. In this position the pot 5 will rotate due to the resistance of rotation induced by the charge. During this phase the lower section will rotate in same direction as and together with the upper section 2, the latter being driven by a machinery.

When the lower section of the furnace pot 5 has rotated through a predetermined angle, the pressure inside the hoses 1 is released whereby the pot 5 and the lifting means 3 will settle in its in-active lower position. The lifting means 3 are retracted to its original or initial position, for example by means of a spring device or the like.

According to the embodiment described the hoses 1 have a uniform diameter, corresponding a linear motion, while the pot rotates. Such difference in direction of motion will be compensated by deformation of the hoses 1. Alternatively, the hoses 1 may have an outwardly increasing diameter producing a curved movement of the hoses which substantially corresponds to the curved movement of the pot 5.

The movement of the lower section (and the upper section) of the pot and the direction of rotation are governed for example by switches and clocks.

I claim:

1. In a furnace of the type having a foundation, a furnace pot normally resting on said foundation, and apparatus for rotating at least an upper section of said furnace pot, the improvement comprising a plurality of transport means distributed along a circle of rotation of the furnace pot, said transport means including:

(a) a base section rigidly secured to the furnace foundation;

(b) a plurality of flexible hoses disposed on an upper surface of said base section, said flexible hoses being operative to receive pressure therein for expansion thereof, said hoses being free to roll on said upper surface;

(c) lifting means disposed on said plurality of hoses, said lifting means being arranged for lifting said furnace pot from said foundation whenever said hoses are expanded, the expansion of said hoses allowing said furnace pot to rotate relative to said foundation; and (d) retractor devices disposed at opposed ends of the transport means for returning the transport means to its original position when pressure is removed from said flexible hoses.

2. The furnace of claim 1, wherein the transport means further comprises a frame for holding the plurality of flexible hoses.

3. The furnace of claim 1 wherein the lower section of the furnace pot and the upper surface of the furnace foundation has a slip-preventing surface.

4. In a furnace of the type having a foundation, a furnace pot having an upper and a lower pot section wherein each section is rotatable independent of the other, and apparatus for rotating at least the upper section of said furnace pot, the improvement comprising the lower portion of said furnace pot normally resting on said foundation and being substantially locked from rotation thereby and a plurality of transport means distributed along a circle of rotation of the furnace pot for lifting said lower portion of said furnace pot from said foundation for allowing rotation thereof with respect to said foundation, said transport means including:

(a) a base section rigidly secured to the furnace foundation;

(b) a plurality of flexible hoses disposed on an upper surface of said base section, said flexible hoses being operative to receive pressure therein for expansion thereof, said hoses being free to roll on said upper surface;

(c) lifting means disposed on said plurality of said hoses, said lifting means being arranged for lifting said furnace pot from said foundation whenever said hoses are expanded, the expansion of said hoses allowing said furnace pot to rotate relative to said foundation; and (d) retractor devices disposed at opposed ends of the transport means for returning the transport means to its original position when pressure is removed from said flexible hoses.

5. Means for lifting a heavy body for movement thereof comprising:

(a) a base section rigidly secured to a foundation;

(b) a plurality of flexible hoses disposed in a frame on an upper surface of said base section, said flexible hoses being operative to receive pressure therein for expansion thereof, and said hoses being free to roll on said upper surface;

(c) lifting means disposed on said plurality of hoses, said lifting means engaging said heavy body for lifting said heavy body from said foundation whenever said hoses are expanded by received pressure therein, the expansion of said hoses allowing said heavy body to be moveable relative to said foundation by rolling thereon; and (d) retractor means affixed to said frame for returning said frame to an initial position.

6. A method for rotating the lower portion of a furnace pot in a split-furnace, said furnace pot having a charge therein, comprising the steps of:

(a) resting said lower portion of the furnace pot on a foundation, said lower portion being thereby locked from motion relative to said foundation;

(b) lifting said lower portion of said furnace pot by means of a transport means including a plurality of flexible hoses wherein said flexible hoses receive pressure for expansion thereof for lifting said lower portion and for enabling substantially friction-free motion of said lower portion relative to said foundation by rolling of said flexible hoses therebetween;

(c) allowing rotation of the charge in said furnace pot to incrementally rotate said lower portion of said furnace pot while said lower portion is lifted;

(d) lowering said lower portion to rest on said foundation after each said incremental rotation by removing pressure from said flexible hoses; and (e) returning said transport means to an initial position after said lower portion is lowered to rest on said foundation.

* * * * *